United States Patent [19]

Chekroun et al.

[11] 4,447,815

[45] May 8, 1984

[54] LENS FOR ELECTRONIC SCANNING IN THE POLARIZATION PLANE

[75] Inventors: Claude D. Chekroun, Bures sur Yvette; Yves C. Michel, Massy, both of France

[73] Assignee: Societe d'Etude du Radant, Les Ulis, France

[21] Appl. No.: 270,519

[22] PCT Filed: Nov. 7, 1980

[86] PCT No.: PCT/FR80/00159

§ 371 Date: Jun. 1, 1981

§ 102(e) Date: Jun. 1, 1981

[87] PCT Pub. No.: WO81/01486

PCT Pub. Date: May 28, 1981

[30] Foreign Application Priority Data

Nov. 13, 1979 [FR] France ..... 79 27873

[51] Int. Cl.[3] ..... H01Q 19/06

[52] U.S. Cl. ..... 343/754; 343/909

[58] Field of Search ..... 343/754, 854, 756, 909, 343/910, 911 L, 911 R

[56] References Cited

U.S. PATENT DOCUMENTS

| | | | |
|---|---|---|---|
| 3,276,023 | 9/1966 | Dorne et al. | 343/754 |
| 3,392,393 | 7/1968 | Spitz | 343/909 |
| 3,708,796 | 1/1973 | Gilbert | 343/756 |
| 4,212,014 | 7/1980 | Chekroun | 343/909 |
| 4,297,708 | 10/1981 | Vidal | 343/754 |
| 4,320,404 | 3/1982 | Chekroun | 343/754 |

FOREIGN PATENT DOCUMENTS

| | | | |
|---|---|---|---|
| 0014650 | 2/1980 | France | 343/754 |

*Primary Examiner*—Eli Lieberman

*Attorney, Agent, or Firm*—Robert F. O'Connell

[57] ABSTRACT

An electrically controlled lens for electronic scanning of a beam emitted by a microwave source in a plane parallel to the electrical field of the emitted radiation comprising individual phase-shifter panels, linked and controlled to give the intercepted microwave radiation a 0°-360° phase shift in the direction of the electrical field vector of the radiation.

6 Claims, 8 Drawing Figures

LENS FOR ELECTRONIC SCANNING IN THE POLARIZATION PLANE

The subject of the present invention is an electronic scanning device permitting a beam emitted by a microwave source to be focused and/or deflected in a plane.

It is known, as described in French Pat. No. 2,063,967, to modify the phase shift of a beam emitted by a microwave source by interposing a dielectric panel along the trajectory of said wave, said panel having a network of conducting wires embedded therein, said wires being connected or disconnected at will by means of switches and specifically by diodes connected to these wires, said networks being located in planes parallel to the electrical field of the incident radiation at every point in the panel. It is likewise known to link a plurality of panels in sequence along the trajectory of the incident microwave radiation. Finally, it is known to focus and deflect the incident microwave radiation in a plane, by using such panels and by adjusting the control voltages on the diodes: an active lens is disposed in the plane perpendicular to the diode-equipped wires embedded in the panels, thus producing electronic scanning in a plane perpendicular to the electrical field of the incident radiation.

The restriction of scanning to a single plane perpendicular to the electrical field of the radiation poses several disadvantages. The electronic scanning device according to the invention, on the other hand, permits scanning in a plane parallel to the electrical field of the incident radiation. It consists in a novel application of the dielectric panels described in French Pat. No. 2,063,967.

DESCRIPTION OF THE INVENTION

The invention can be described in more detail with the help of the drawings wherein FIG. 1 shows exemplary panels of the type used in the device of the invention;

Figure 1:
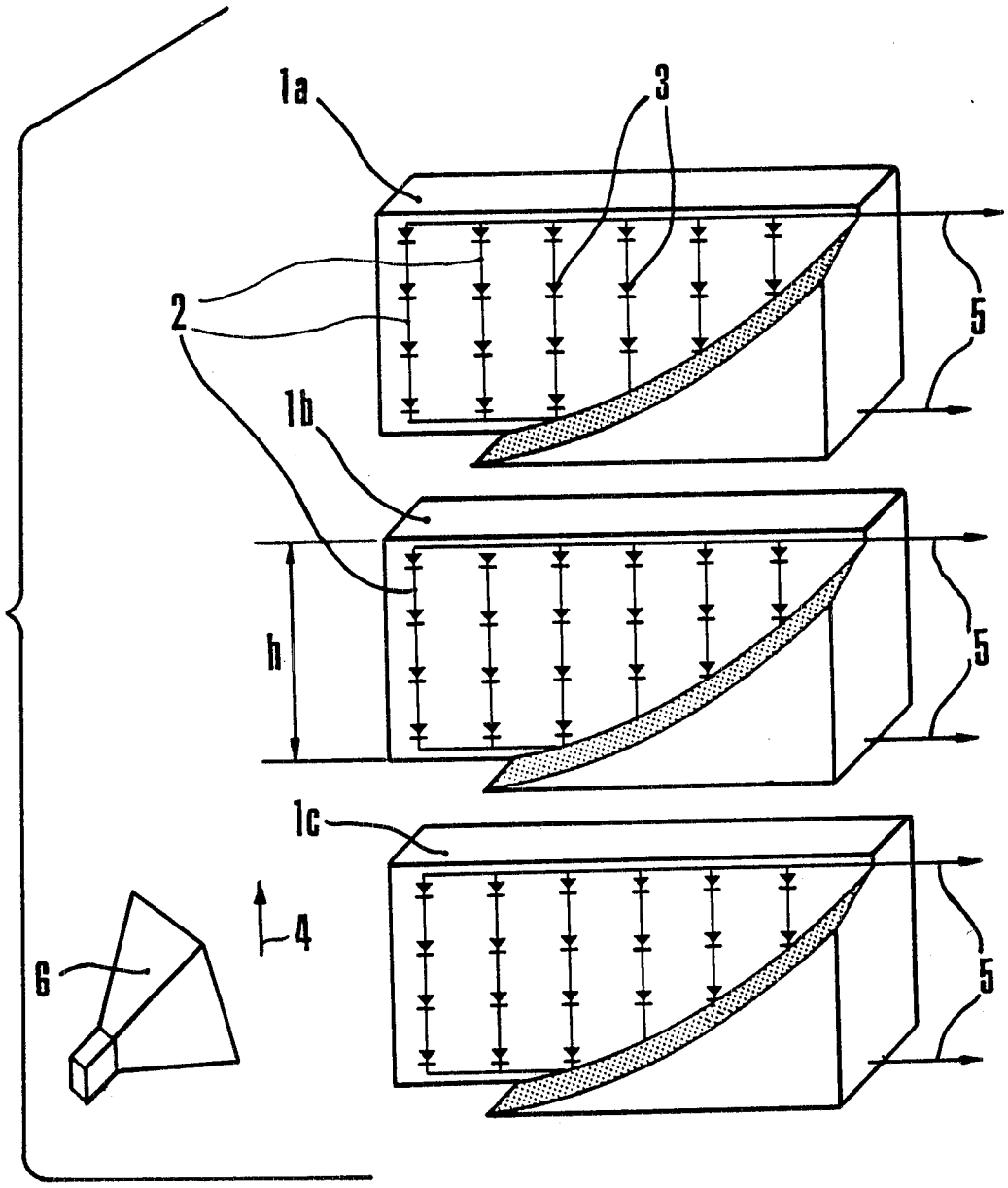
Figure 2:
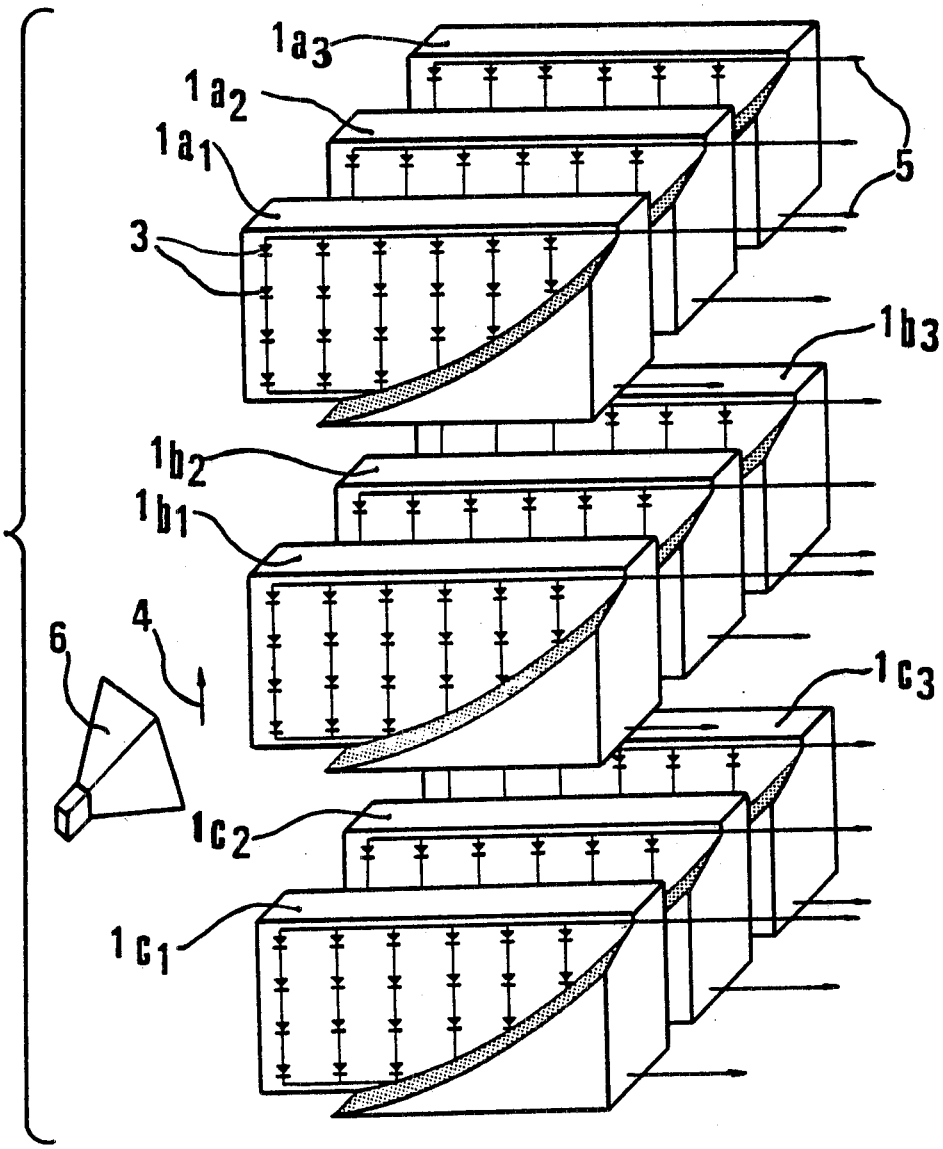
FIG. 2 shows exemplary linked panels of the type used in the invention.

To construct the electronic scanning device in accordance with the subject of the invention, a plurality of dielectric panels (1*a*, 1*b*, 1*c*, . . . ) are assembled as shown in FIG. 1 wherein flat networks of conducting wires (2) are embedded, said wires being connectable or disconnectable at will by means of diodes (3) connected to said wires, in such fashion that the wires in all the networks are parallel to the electrical field vector (4) of the incident radiation emitted by a microwave source (6), so that all of the diodes in each panel are controlled simultaneously and identically by a voltage sufficient to make them conducting or nonconducting, as desired, said voltage being applied to the leads of control wires (5) perpendicular to the electrical field, but with no effect thereon, and so that all the panels (1*a*, 1*b*, 1*c*, . . . ) are superimposed in a single plane to form an assembly through which the incident wave propagates. Of course it is possible to link a plurality of panels (1$a_1$, 1$a_2$, 1$a_3$ . . . ; 1$b_1$ . . . ) in sequence along the trajectory of the incident microwave radiation: in this case, the linked superimposed panels (1$a_2$, 1$b_2$, 1$c_2$) are in the same plane as shown in FIG. 2. All of the linked panels have the same dimensions in the direction of the wires with the diodes. All the superimposed panels have the same structure ($a_1$, $b_1$, $c_1$). The linked panels can have different structures ($a_1$, $a_2$, $a_3$).

Since all of the diodes in a panel are controlled simultaneously and identically, the effect of this panel on the phase shift of the wave passing through it is uniform. By grouping a succession of superimposed panels along the trajectory of the wave, and by controlling all the diodes in each group using voltages of the same polarity, the incident radiation is subjected to a uniform phase shift and can change from 0°–360° in steps which are a function of the number of panels assembled to form each group.

If the diodes in different superimposed panels in a given plane are controlled by voltages with different polarities, different effects are produced in the wave, thus creating a phase gradient.

The incident radiation can be broken down into as many parallel channels as there are superimposed panels. The resultant phase shift is uniform in each channel and can vary from one channel to another. By varying this phase shift from one channel to another, by varying the control voltage on the diodes in each panel, the incident radiation can be either focused or deflected in the plane parallel to the diode-carrying wires. The choice of the size of the panels in the direction of the diode-carrying wires depends on the conditions for suppression of the grating lobes of the antenna diagram produced by the combination of the above panels illuminated by an incident plane wave whose electrical field vector is parallel to the diode-carrying metal wires. When the phase shifter elements are juxtaposed to scan a microwave beam in a direction $\theta$, it is known that in order to prevent the appearance of grating lobes, a certain relationship must be maintained between the spacing of the phase shifter elements, the wavelength, the sine of the scanning angle $\theta$, and the number N of juxtaposed elements, written as follows:

$$d \leqq \frac{\lambda\left(1 - \frac{1}{N}\right)}{1 + \sin\theta}.$$

The lateral dimension in the direction perpendicular to the diode-carrying wires depends on the width of the desired main lobe and is sufficient to intercept the diameter of the microwave beam emitted by the source located in front of the panel. As is known, the spacing of the diodes, the spacing of the wires, and the thickness of the dielectric are selected as a function of the desired phase shift, the characteristics (especially capacitance), of the diodes, of the dielectric constant of the material, and of the wavelength of the incident electromagnetic energy.

The optimum spacing of the phase shifter elements desired in all electronic scanning antennas is close to the half-wavelength of the radiated microwave energy. It is known that for a phase shifter element spacing less than or equal to the half-wavelength of the radiated microwave energy, no grating lobe will appear in the radiation diagram of an antenna constructed in this fashion, regardless of the scanning angle under study. In contrast to electronic scanning antennas that use waveguide phase shifters, the process according to the invention makes it easy to meet this condition, in other words, to select the height h of a panel measured in the direction of the diode-carrying wires which is less than or equal to the half-wavelength of the microwave energy radiated by the microwave source (see FIG. 1).

The length of the diode-carrying wires incorporated in the dielectric is equal to the height h of the panel but less than or equal to the half-wavelength of the radiated microwave energy if it is desired to prevent grating lobes from appearing in a radiation diagram. The number of diodes on each diode-carrying wire in a panel will be small but can vary from 1 to 10 diodes depending on the capacitance of the selected diodes and the phase shift desired.

The voltage applied to the diode-carrying wire, said diodes being connected in the same direction on said wire, in order for each diode to be blocked and for the wire to be divided electrically into sections, is equal to the product of the number of diodes and the voltage which must be applied in reverse to a single diode to block it, i.e., approximately 20 volts. If four diodes are connected to the wire, for example, the voltage at the ends of the wire on which the diodes are mounted required to divide it into sections will be 80 volts. A voltage of 5 volts applied with opposite polarity to the ends of the wire will make this wire conduct. The opposite voltage on the order of 80 volts volts is sufficiently weak not to require special insulation in the panel or on the outside of the panel; the power supply and the commutator used to supply these voltages, then apply them to and disconnect them from a panel in very short time periods (10 ms) will thus be extremely easy to make, in view of the low voltage required by contrast with the voltages required for other scanning devices.

The drive voltage to the diodes in a panel is advantageously applied either by two control wires, one linking all of the upper ends of the diode-carrying wires mounted in the same direction, and the other connecting all the lower ends, or by three control wires, one connecting all the midpoints of the diode-carrying wires, said diodes being mounted in this case in two identical groups in opposite directions, with the other two connecting the upper and lower ends of all the diode-carrying wires in the panel to a point outside the panel; these control wires, which are perpendicular to the diode-carrying wires and therefore perpendicular to the electrical field vector of the microwave radiation, have no effect upon the latter. The configuration with three control wires considerably simplifies the choice of diodes.

By reducing the number of diodes in series, mounted in the same direction, the magnitude of the potential difference required to cut the diode carrier wire into sections electrically is reduced still further, equal division of the diode-blocking voltages along the diode-carrying wire is facilitated and accomplished in a shorter time, and the balancing resistor with a very high value, which had to be connected in parallel with each diode when working with very powerful microwave radiation, can be eliminated.

Figure 3:
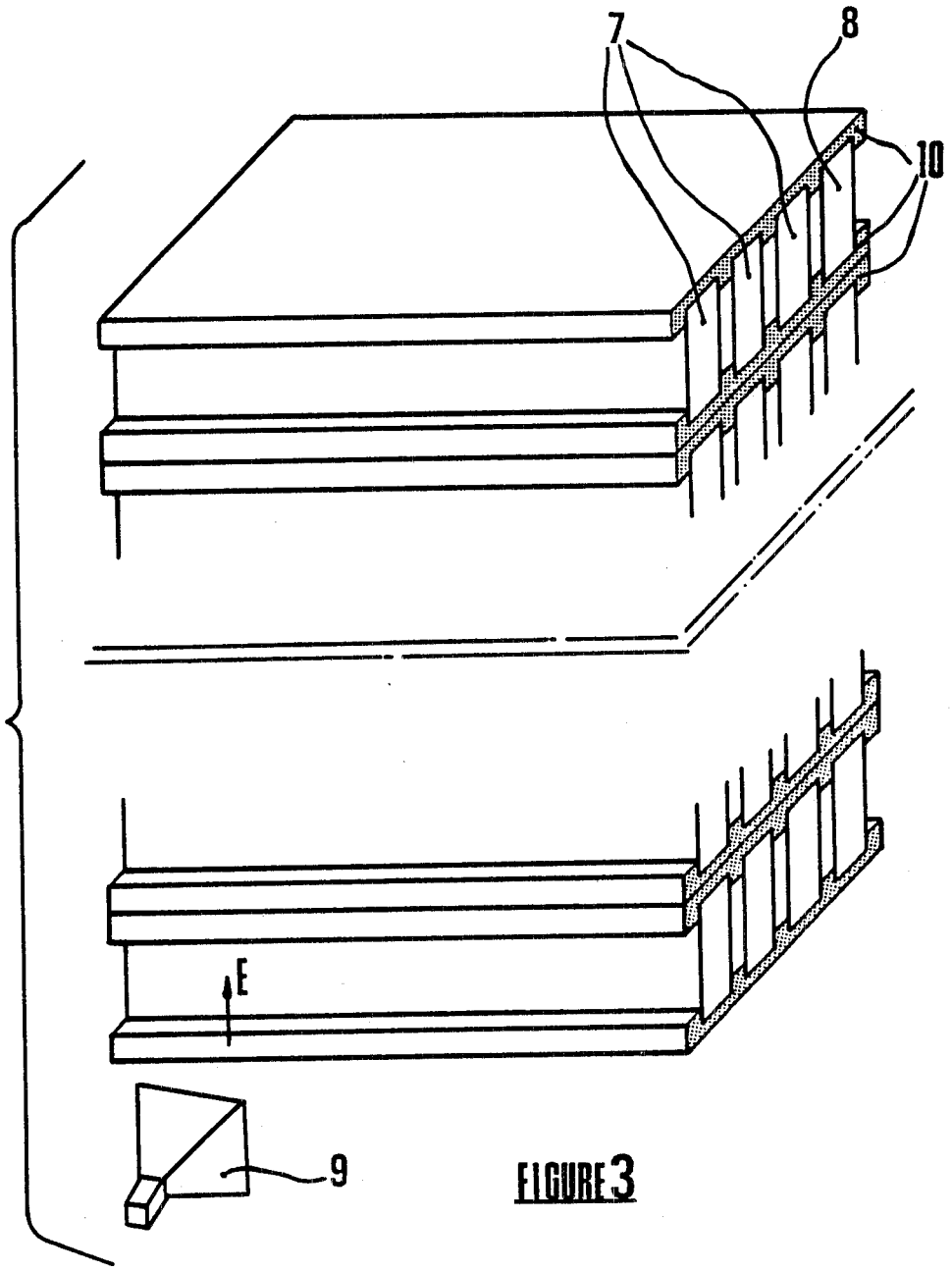
FIG. 3 shows a portion of an electronic scanning device of the invention using panels of the type shown in FIGS. 1 and 2.

The following is a nonlimiting example describing the construction of an active electronic lens which allows the implementation of the process according to the invention with reference to FIG. 3.

Figure 3A:
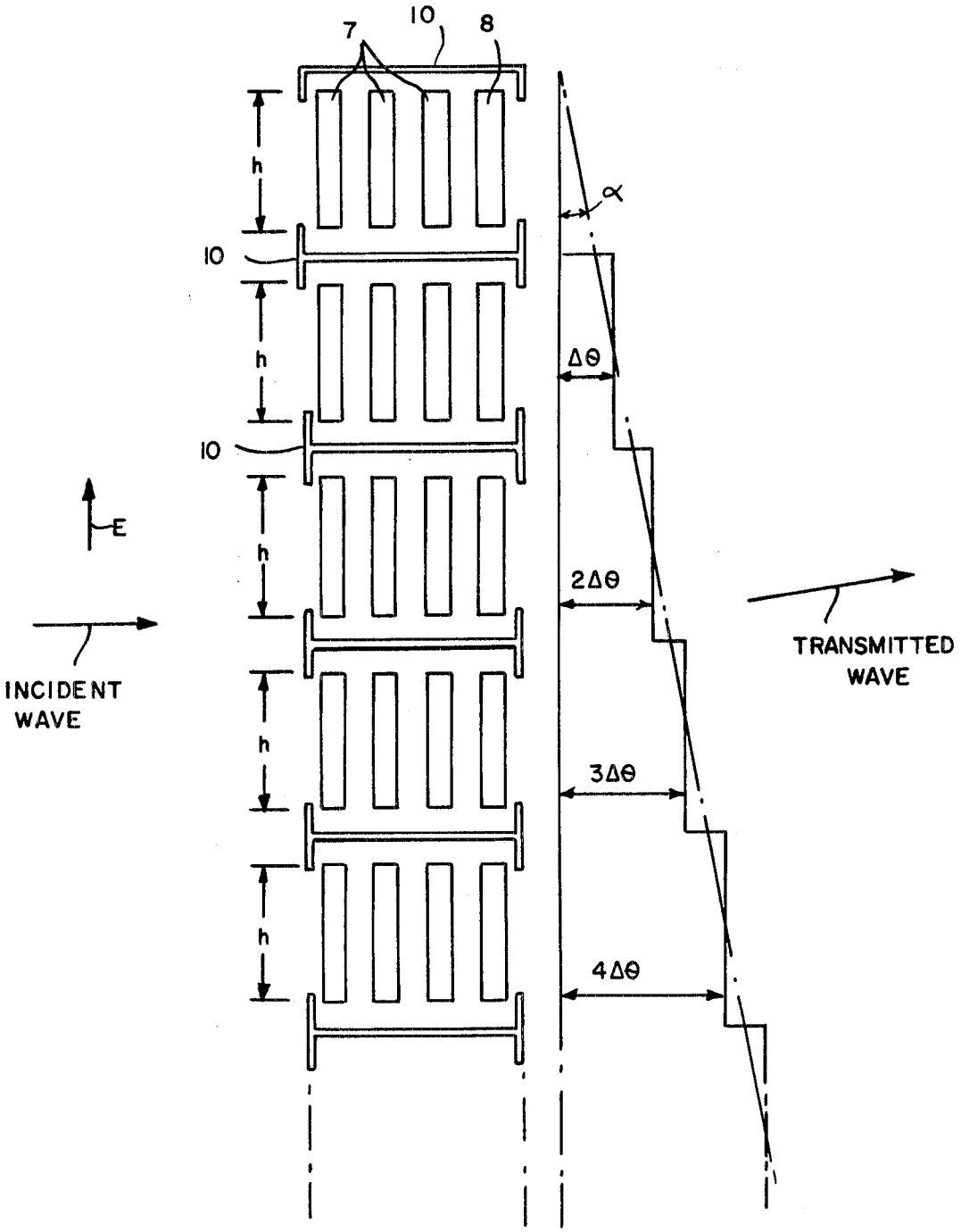
FIG. 3A shows a schematic diagram of the phase shifts produced by a portion of the successive panel assemblies of the device of FIG. 3.
Figure 4:
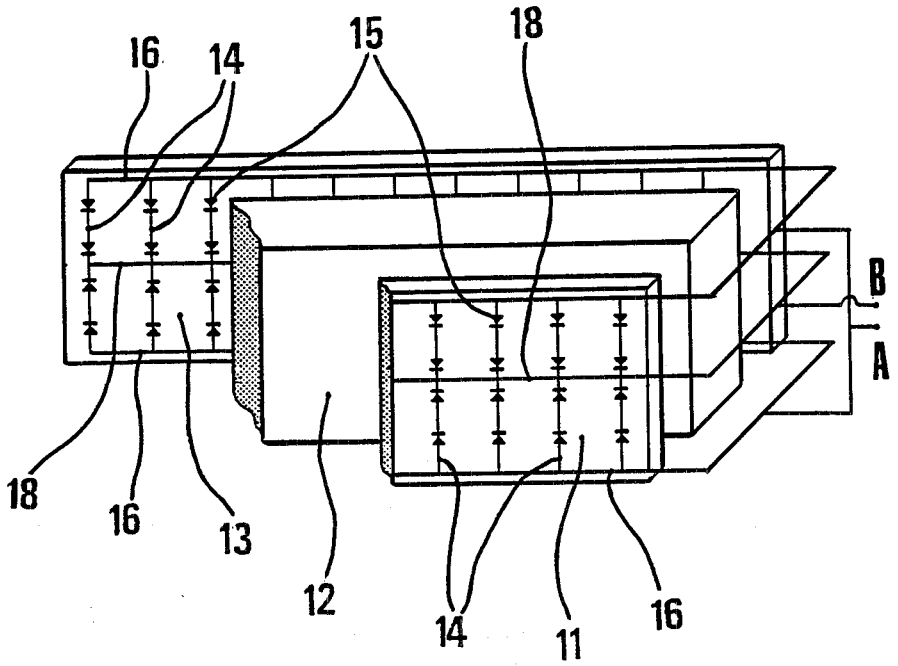
FIG. 4 shows a more detailed embodiment of a panel of one type used in the device of FIG. 3.

This active lens consists of 124 panels forming four layers of 31 superimposed panels, arranged one behind the other along the trajectory of an incident microwave emitted by a source at a frequency of 3100 megahertz. Each of the 93 identical panels (7) of the first three layers of superimposed panels, by changing the state of its diodes, can shift the phase of the incident microwave radiation through 90°. Each of the 31 identical panels (8) in the fourth layer of panels can produce a phase shift of 45°. Each of the 31 groups consisting of three panels (7) and one panel (8) connected in series and intercepting the same channel of the incident microwave (E) can shift the phase of the latter from 0°–360° in 45° increments. These 31 groups of four panels are mounted mechanically on 32 plane metal plates (10) perpendicular to the diode-carrying networks, and hence to the electrical field vector (E) of the incident microwave radiation. The thickness of these metal plates, perpendicular to the electrical field (E) of the microwave radiation, is less than 1/20 of this wavelength and therefore produces no measurable effect on it. FIG. 3A shows a diagrammatic view of a portion of the structure in FIG. 3 depicting the phase shifts with respect to the assemblies of panels of FIG. 3. FIG. 4 shows one of the 93 panels of the first three layers of the electronic scanning device or active lens. This panel, 1 m long and 45.3 mm high, comprises three sheets of dielectric (11), (12), and (13). Sheets (11) and (13) are 0.5 mm thick and have a dielectric constant of 5; sheet (12) is 3.5 mm thick and has a dielectric constant of 4.1.

These three sheets are mounted one behind the other along the trajectory of the incident microwave radiation, at intervals of 7 mm. Thirty-two metal wires (14), 0.5 mm in diameter and with a length equal to the height of the panel, i.e., 45.3 mm, are mounted on the outside faces of sheets (11) and (13) at 30 mm intervals; these wires (14) are parallel to the electrical field vector of the incident microwave radiation, and each carries 4 switching diodes (15) of the PIN type soldered at 11.33 mm intervals. These 4 diodes (15) are soldered to each wire (14) so that in terms of current flow, they are oriented toward a point located in the middle of wire (14); hence, there are 2 diodes in series in one direction and 2 diodes in series in the opposite direction on each wire (14). The upper ends of wires (14) are connected to a metal wire (16) located at the top of each of sheets (11) and (13), perpendicular to wires (14) and thus connected to terminal A of a voltage and/or current source located outside the panel and associated therewith. Similarly, the lower ends of wires (14) are connected by the metal wires to the same terminal A of this voltage and/or current supply.

All the points located at the midpoints of wires (14) of sheets (11) and (13) are connected and linked together by a metal wire (18) 0.5 mm in diameter, perpendicular to wire, (14), to the other terminal B of the same voltage and/or current supply. The differential phase shift produced by this panel in the incident microwave radiation between the two polarities of terminals A and B of the power supply, simultaneously and identically controlling the 256 diodes in the panel, is 90°.

Figure 5:
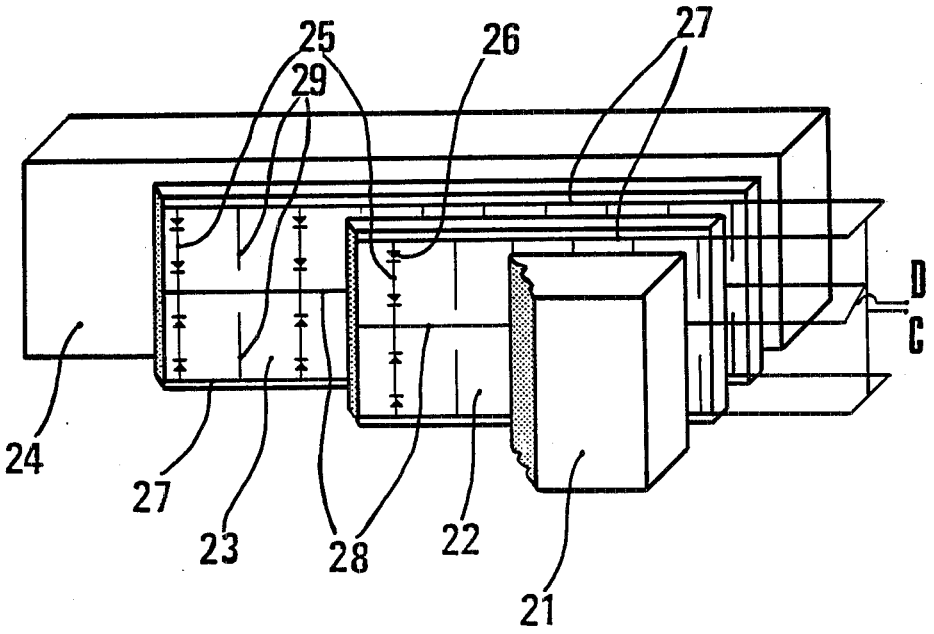
FIG. 5 shows a more detailed embodiment of a panel of another type used in the device of FIG. 3.

FIG. 5 shows one of the 31 panels in the fourth layer of the active lens; this panel, 1 m long and 45.3 mm high, comprises four sheets of dielectric (21), (22), (23), and (24). Sheets (21) and (24) are 3 mm thick and have a dielectric constant of 5 while sheets (22) and (23) are 0.5 mm thick and have a dielectric constant of 4.1. These four sheets of dielectric are mounted one behind the other along the trajectory of the incident microwave at the following intervals: 5 mm between sheets (21) and (22), 11 mm between (22) and (23), and 5 mm between (23) and (24). Twenty-four metal wires (25), 0.5 mm in diameter and with a length equal to the height of the panel, i.e., 45.3 mm, are mounted on the outside faces of sheets (22) and (23) at 40-mm intervals. These wires (25) are parallel to the electrical field vector of the incident microwave radiation and each carries four PIN-type switching diodes (26) soldered at intervals of 11.33 mm. These four diodes are soldered to each wire (25) so that in terms of current flow, they are oriented toward the midpoint of wire (25). Hence, there are two diodes in series in one direction and two diodes in series in the other direction in each wire (25). The upper and lower ends of all of the diode-carrying conductor wires (25) in the panel are connected by two perpendicular conductor wires (27) to terminal C of a power supply outside the panel and specific to this panel. All points at the midpoints of all wires (25) are connected by two perpendicular conductor wires (28), 0.5 mm in diameter to the other terminal D of the same voltage supply. The same faces of sheets (22) and (23), at the midpoints of the intervals between wires (25), carry sections of metal wires (29) 0.5 mm in diameter and 20.5 mm long. The differential phase shift in the incident wave, caused by the panel, resulting from the polarity reversal at terminals C and D, is 45°. Referring to FIG. 3, we see that the assembly composed of 124 panels in a rigid block forming an active lens operates through 32 metal plates (10), measuring 1000 mm long by 110.5 mm wide and 2.6 mm thick.

Figure 6:
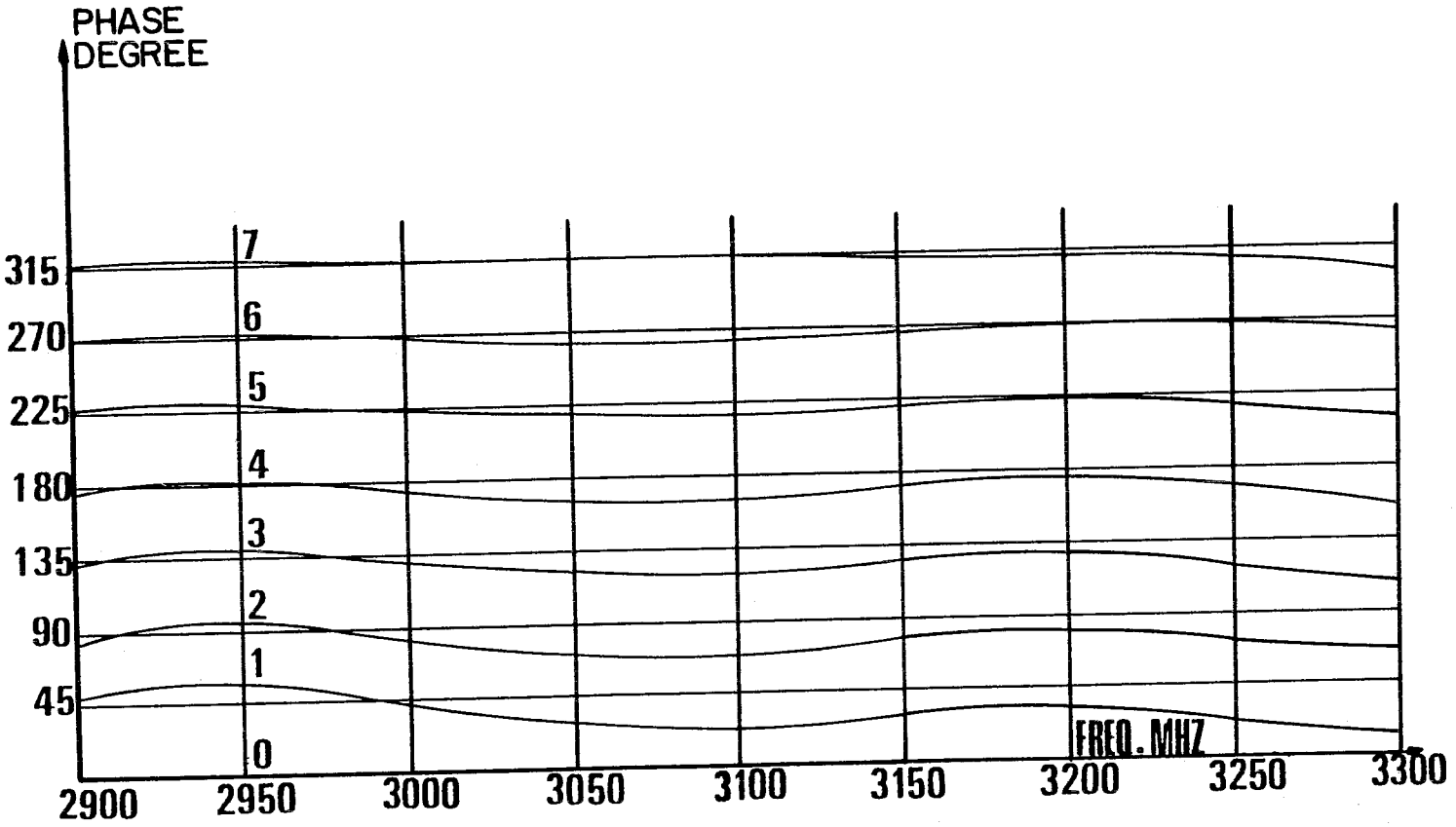
FIG. 6 depicts phase shift values produced by an assembly of three panels of the type shown in FIG. 4 and one panel of the type shown in FIG. 5.

FIG. 6 shows the phase shift values produced by introducing a combined group of panels composed of three panels (7) and one panel (8) along the trajectory of an incident microwave at 3100 megahertz, showing all the possible combinations of the states of the diodes in each of the panels.

Figure 7:
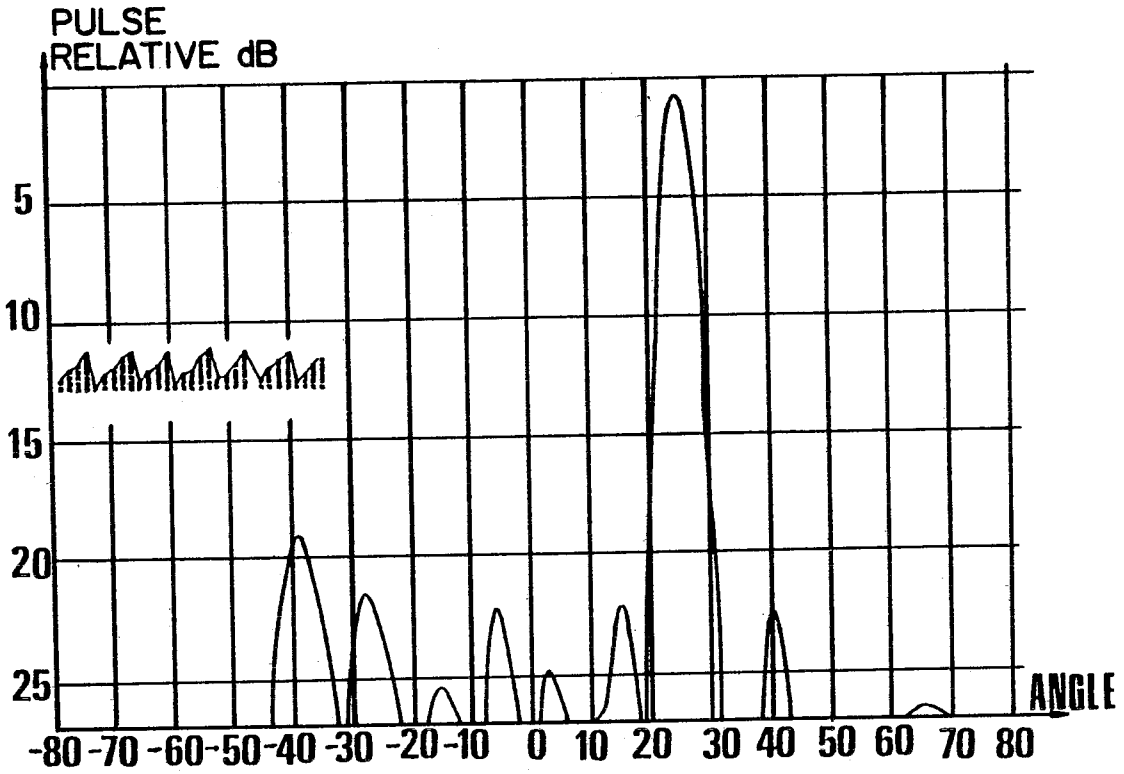
FIG. 7 shows a graph depicting radiation produced by an overall device described with reference to FIGS. 3, 4 and 5.

We see that this phase shift assumes the eight values which are multiples of 45° between 0° or 360° and 315°. FIG. 7 shows the graph of the radiation produced by illuminating the active lens as described in FIGS. 3, 4, and 5 by a 3100 megahertz microwave whose electrical field vector is parallel to the wires carrying the diodes in the lens. Each of the 31 groups of panels in the lens is controlled to produce the staircase phase law indicated in the figure, oriented in the direction of the electrical field vector of the incident wave. The result is an angular scanning of the incident microwave beam at 25.07° in the plane comprising the electrical field vector.

We claim:

1. Electronic scanning device comprising a plurality of dielectric panels each panel having flat networks of conducting wires embedded therein, said wires being capable of being continuous or discontinuous as desired by means of diodes mounted on said wires and said wires being embedded in such fashion that the wires in all the networks are parallel to the electrical field vector of an incident electromagnetic wave emitted by a microwave source, wherein the height of each said panel is less than the dimension of the incident electromagnetic wave and all the diodes in each panel are controlled simultaneously and identically by a single device, said panels being arranged in a plurality of assemblies thereof, each assembly comprising a plurality of adjacent panels extending in a direction generally along the trajectory of said electromagnetic wave and said assemblies being superimposed one on the other in a direction generally parallel to the electric field of said electromagnetic wave to form the entire device through which the electromagnetic wave propagates, and further wherein said assemblies are linked along the trajectory of the incident electromagnetic wave, each of the panels producing a phase shift in the wave, and each assembly, by means of an appropriate control device, providing a phase shift ranging from 0° to 360° in the plane parallel to the electrical field vector of the electromagnetic wave traversing the device.

2. Electronic device for scanning in a plane parallel to the electrical field vector of an incident electromagnetic wave traversing it in accordance to claim 1, wherein each panel has a length which permits it to intercept the entire incident electromagnetic wave.

3. Electronic device for scanning in a plane parallel to the electrical field vector of an electromagnetic wave traversing it in accordance with claim 2, wherein all the superimposed or linked panels are of the same height, said height being on the order of the wavelength of the electromagnetic wave passing through the device.

4. Electronic device for scanning in a plane parallel to the electrical field vector of an electromagnetic wave traversing it, in accordance with claim 3, wherein the number of panels linked and the panel type are such that the degree of phase shift produced in the electromagnetic wave, by each of them, whether along or in combination with the phase shift produced by the others, causes a phase shift of between 0° and 360° in the electromagnetic wave.

5. Electronic device for scanning in a plane parallel to the electrical field vector of an electromagnetic wave traversing it in accordance with claim 3, wherein the single device for simultaneously controlling the diodes in a panel, for the purpose of supplying the diodes, comprises metal conductor wires located perpendicular to the electrical field of the wave and connecting all the diode-carrying wires in a panel.

6. Electronic device for scanning a plane parallel to the electrical vector of an electromagnetic wave traversing it in accordance with claim 3, wherein the superimposed assemblies are separated from one another by metal plates which are common to all the linked panels, said plates being perpendicular to the electrical field vector of the electromagnetic wave and being capable of supporting the control wires, the thickness of said plates being less than 1/20 of the wavelength of said electromagnetic wave.

* * * * *